US005184529A

United States Patent [19]

Matsubara et al.

[11] Patent Number: 5,184,529

[45] Date of Patent: Feb. 9, 1993

[54] TOOL FOR LOOSENING OR TIGHTENING SPARK PLUG

[75] Inventors: Yoshiaki Matsubara; Kouzou Amano; Takao Kojima, all of Aichi, Japan

[73] Assignee: NGK Spark Plug Co., Ltd., Nagoya, Japan

[21] Appl. No.: 834,040

[22] Filed: Feb. 12, 1992

[30] Foreign Application Priority Data

Feb. 14, 1991 [JP] Japan ..... 3-043009

[51] Int. Cl.[5] ..... B25B 13/06

[52] U.S. Cl. ..... 81/125; 81/124.5; 81/124.6

[58] Field of Search ..... 81/121.1, 125, 3.4, 81/124.4–124.6

[56] References Cited

U.S. PATENT DOCUMENTS 4,714,138 12/1987 Zaccone ..... 81/3.4
5,009,133 4/1991 Carey ..... 81/121.1
5,074,173 12/1991 Cearley ..... 81/125

*Primary Examiner*—D. S. Meislin
*Attorney, Agent, or Firm*—Foley & Lardner

[57] ABSTRACT

A tool is provided for loosening or tightening a spark plug while interposing a gasket and a pressure sensor between the spark plug and a cylinder head. The tool consists of concentric, relatively rotatable inner and outer cylinders. The inner cylinder is engageable with the spark plug for rotation together therewith and for loosening or tightening the same. The outer cylinder is lockingly engageable with a cylinder head by means of an axial projection of the outer cylinder and a groove of the cylinder head. The outer cylinder is further lockingly engageable with the gasket by means of a locking leg of the outer cylinder and a peripheral cut of the gasket. The gasket is thus lockingly engageable with the cylinder head by way of the outer cylinder for preventing the pressure sensor from rotating relative to the cylinder head when the spark plug is loosened or tightened.

12 Claims, 3 Drawing Sheets

TOOL FOR LOOSENING OR TIGHTENING SPARK PLUG

BACKGROUND OF THE INVENTION

1. Field of the Invention

The present invention relates in general to a tool for loosening or tightening a spark plug on a cylinder head of an internal combustion engine and more particularly to an improved socket wrench for a spark plug.

2. Description of the Prior Art

A socket for an impact wrench is well known in the art and used for loosening or tightening a spark plug. This socket is in the form of a hollow cylinder having a hexagonal opening adapted for fitting a hexagonal portion of a spark plug.

In some instances, a ring-shaped pressure sensor is installed between a spark plug and a cylinder head. This pressure sensor is used for measuring the pressure within an engine cylinder and thereby detecting a combustion condition of an engine. The pressure sensor is fixed to the cylinder head when the spark plug is tightened and is operable to convert a cylinder pressure to an electric signal by means of a built-in piezoelectric ceramic element, which electrical signal is taken out to the outside through a lead wire of the pressure sensor.

Since the automobile engine compartment is jammed with a number of engine accessories or automotive parts, a lead wire that is too long may possibly interfere with other parts or may possibly contact the same to be damaged or broken. For this reason, the lead wires of each part are usually designed to be of a minimum possible length. The pressure sensor is no exception to this. Accordingly, unless the pressure sensor is arranged to point in a predetermined direction, the lead wire may be too short to reach a part to be connected. For this reason, the pressure sensor needs to be arranged in a position of pointing in a predetermined direction.

Further, rotation of the pressure sensor may possibly cause a twist of the lead wire and a breakage of the same or the joint between the pressure sensor body and the lead wire may be pressed against the wire receiving groove to cause a crack at the joint.

However, with the conventional wrench socket for a spark plug, the pressure sensor remains rotatable until the spark plug is tightened and is thus driven to rotate in response to the tightening of the spark plug. Accordingly, it has been difficult to fix the pressure sensor while holding it in a position of pointing in a predetermined direction.

SUMMARY OF THE INVENTION

In accordance with the present invention, there is provided a tool for loosening or tightening a spark plug while interposing a pressure sensor between the spark plug and a cylinder head.

The tool comprises concentric, relatively rotatable inner and outer cylinders. The inner cylinder has engaging means for engaging the spark plug and is thereby rotatable together therewith for loosening or tightening the spark plug. The outer cylinder has preventing means for preventing the pressure sensor from being driven to rotate relative to the cylinder head when the spark plug is driven for its loosening or tightening.

The above structure is effective for solving the above noted problems inherent in the prior art device.

It is accordingly an object of the present invention to provide a novel and improved tool for loosening or tightening a spark plug, which spark plug is installed on a cylinder head by interposing therebetween a pressure sensor, which can assuredly hold the pressure sensor in a position of pointing in a predetermined direction without being affected by rotation of the spark plug for its loosening or tightening.

It is a further object of the present invention of the above described character to prevent the pressure sensor from being damaged at the time of loosening and tightening of the spark plug.

It is a further object of the present invention to provide a novel and improved tool of the above described character which can be readily used in the current internal combustion engines.

DETAILED DESCRIPTION OF THE PREFERRED EMBODIMENTS

Figure 1:
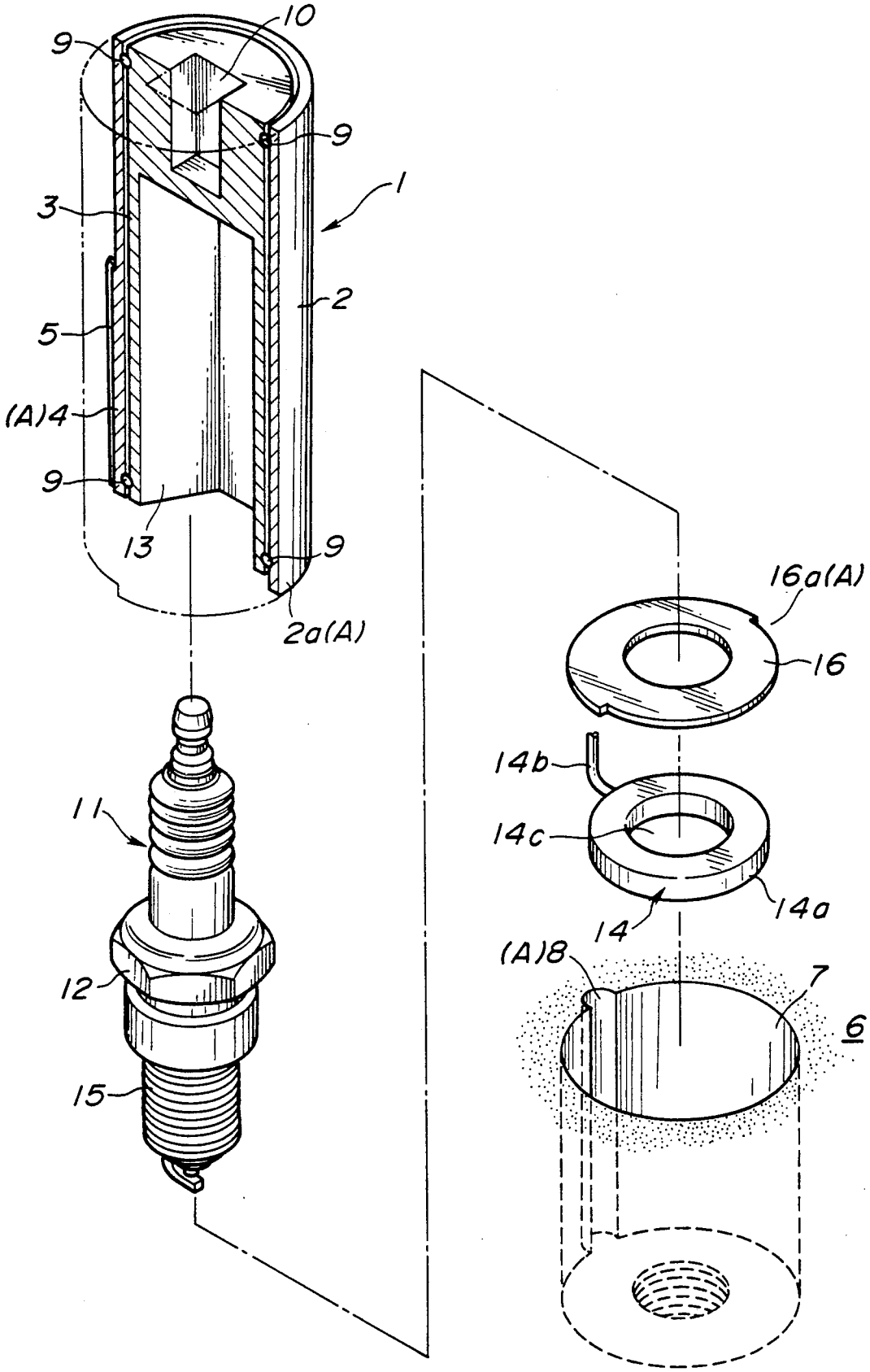
FIG. 1 is a perspective view of a spark plug loosening or tightening tool according to an embodiment of the present invention, together with a spark plug, gasket, pressure sensor and a spark plug attaching hole of a cylinder head.
Figure 2:
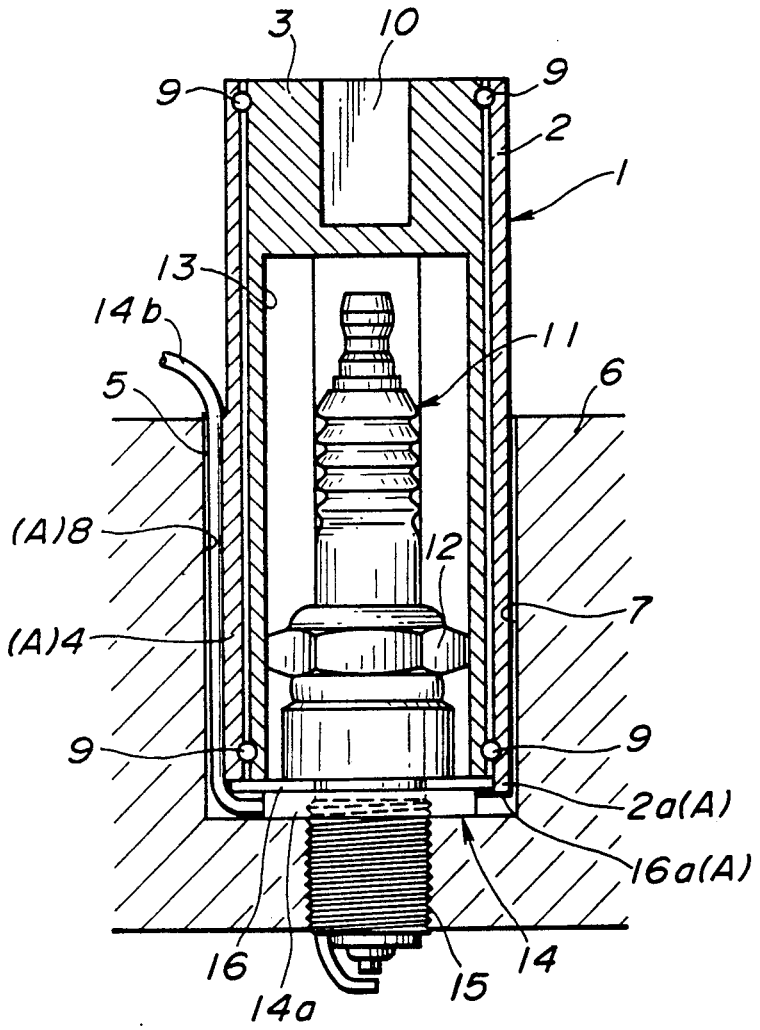
FIG. 2 is a longitudinal sectional view of the spark plug loosening or tightening tool of FIG. 1, with the spark plug being in an installed or tightened position.

Referring first to FIGS. 1 and 2, a spark plug loosening or tightening tool 1 of the present invention is in the form of a wrench socket consisting of a hollow, outer cylinder 2 and an inner cylinder 3 concentrically and rotatably installed in the outer cylinder 2.

The outer cylinder 2 has on an outer circumferential surface an axially elongated projection 4 of a generally semi-circular cross section and having at its top end an axially elongated groove 5 for receiving therein a lead wire 14*b* of a pressure sensor 14. The outer diameter of the outer cylinder 2 is a little smaller than the inner diameter of a spark plug attaching hole 7 of a cylinder head 6. A wall defining the spark plug attaching hole 7 is partly recessed to define an axially elongated wire receiving groove 8 of a generally semi-circular cross section, so that the axial projection 4 of the outer cylinder 2 is engageable with the wire receiving groove 8. Accordingly, when the tool 1 is inserted into the spark plug attaching hole 7 in such a way that the axial projection 4 is engaged with the wire receiving groove 8, the outer cylinder 2 cannot rotate relative to the cylinder head 6 although the former is axially movable relative to the latter.

The inner cylinder 3 is rotatable on the inner circumferential surface of the outer cylinder 2 by the effect of a plurality of small balls 9 running in grooves formed in the mating surfaces of the inner and outer cylinders 3 and 2. The inner cylinder 3 has at an upper end portion thereof an attaching hole 10 of a square cross section in which a correspondingly shaped drive shaft of an impact wrench (not shown) is fitted and at a lower end portion thereof a hexagonal hole 13 for fitting a hexagonal portion 12 of a spark plug 11.

A pressure sensor 14 for installation between the spark plug 11 and cylinder head 6 is of the known type and consists of an annular sensor body 14*a* and a lead wire 14*b* connected thereto. A threaded portion 15 of the spark plug 11 passes through a central opening 14*c* of the pressure sensor 14. A gasket 16 formed from a copper plate is disposed between the pressure sensor 14 and the spark plug 11.

The outer cylinder 2 is provided with a locking means "A" for preventing rotation of the pressure sensor 14 relative to the cylinder head 6 at the time of loosening or tightening of the spark plug 11. The locking means "A" includes the axial projection 4 and the lead wire receiving groove 8 which are engageable with each other for preventing relative rotation between the outer cylinder 2 and the cylinder head 6. The locking means "A" further includes a peripheral cut 16*a* of the gasket 16 and a lower end locking leg 2*a* of the outer cylinder 2 which are engageable with each other for preventing relative rotation between the outer cylinder 2 and the gasket 16. More specifically, the peripheral cut 16*a* of the gasket 16 is semi-circularly shaped and is sized so as to make the peripherally cut half of the outer periphery of the gasket 16 of substantially the same diameter as the inner diameter of the outer cylinder 2. The locking leg 2*a* is shaped correspondingly to the peripheral cut 16*a* of the gasket 16 and has a length substantially equal to the thickness of the gasket 16 so that the locking leg 2*a* is fittingly engageable with the peripheral cut 16*a*. Therefore, the outer cylinder 2 and the gasket 16 are directly engageable to prevent rotation of the gasket 16 even if the gasket 16 receives a driving force from the spark plug 11 at the time of loosening or tightening of the spark plug 11. While the pressure sensor 14 is pressed against the lower surface of the gasket at the time of installation of the spark plug 11, it will not rotate since the gasket, 16 is held stationary.

Figure 3:
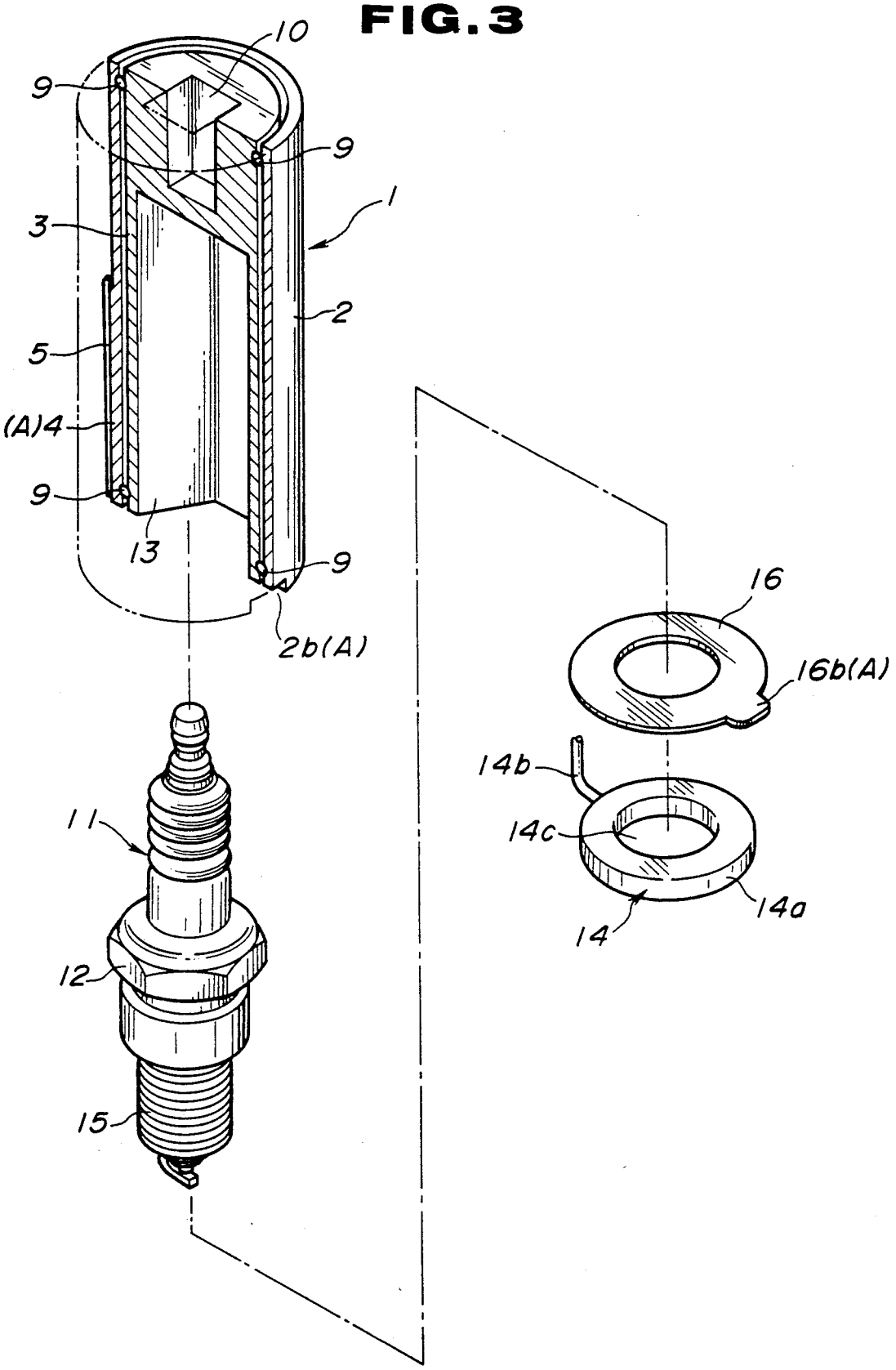
FIG. 3 is a view similar to FIG. 1 but shows a variant of a locking means.

While the present invention has been described and shown as above, it is not for the purpose of limitation. For example, as shown in FIG. 3, the locking means "A" may be constituted by a peripheral projection or finger 16*b* of the gasket 16 and a cut or recess 2*b* of the outer cylinder 2. Further, the locking means "A" may be constituted by a projection and recess provided on the outer cylinder 2 and the pressure sensor 14 so that both are directly engaged to prevent relative rotation therebetween.

The spark plug 11 and pressure sensor 14 are installed on the cylinder head 6 by using the tool 1 of this invention as follows.

As seen from FIG. 1, the spark plug 11, gasket 16 and pressure sensor 14 are joined in such a manner that the threaded portion 15 passes through the gasket 16 and the pressure sensor 14. The spark plug 11, gasket 16 and pressure sensor 14 are then installed in the spark plug attaching hole 7 of the cylinder head 6 in such a manner that the lead wire 14*b* of the pressure sensor 14 is received in the groove 8 of the cylinder head 6. The tool 1 is then fitted on the spark plug 11 in such a manner that the axial projection 4 is engaged in the groove 8 and the lead wire 11 is received by the groove 5, the hexagonal portion 12 of the spark plug 11 and the hexagonal portion 13 of the inner cylinder 3 are engaged with each other, and the locking leg 2*a* of the outer cylinder 2 is engaged in the peripheral cut 16*a* of the gasket 16.

Under this condition, the inner cylinder 3 is rotated by means of a tool handle or wrench handle (not shown) thereby causing the spark plug 11 to be screwed into the cylinder head 6. In this instance, the spark plug 11 rotates relative to the gasket 16 while being strongly pressed against the same, thus causing the gasket 16 to be subjected to a driving force. However, by the effect of locating engagement with the outer cylinder 2, the gasket does is not rotate but is held stationary relative to the outer cylinder 2. Accordingly, no driving force is transferred from the gasket 16 to the pressure sensor 14, thus making it possible to attain the tightening of the spark plug 11 without causing any rotation of the pressure sensor 14.

From the foregoing, it will be understood that a tool or wrench socket of this invention has a two-part structure consisting of an outer cylinder for providing locking engagement between a gasket and a cylinder head and an inner cylinder rotatable on the outer cylinder for loosening or tightening a spark plug, whereby rotation of the pressure sensor otherwise caused at the time of loosening and tightening of the spark plug is prevented by the outer cylinder. Accordingly, it becomes possible to loosen or tighten the spark plug while holding the pressure sensor in a correctly directed position, and therefore there is not any problem such as breakage of a lead wire of the pressure sensor or a crack at the joint between the pressure sensor body and the lead wire, which may otherwise be caused at the time of tightening of the spark plug. Furthermore, since the spark plug loosening or tightening tool of this invention does not require any particular design change of the cylinder head, it can be readily used in the current engines.

What is claimed is:

1. A tool for loosening or tightening a spark plug while interposing a pressure sensor between the spark plug and a cylinder head, comprising:

concentric, relatively rotatable inner and outer cylinders;

said inner cylinder having engaging means for engaging the spark plug and thereby rotating together therewith for loosening or tightening the spark plug; and said outer cylinder having preventing means for preventing the pressure sensor from rotating relative tot eh cylinder head when the spark plug is loosened or tightened;

wherein said preventing means comprises fist locking means for lockingly engaging said outer cylinder with the cylinder had and second locking means for lockingly engaging said outer cylinder with a gasket which is interposed between the spark plug and the pressure sensor.

2. The tool according to claim 1, wherein said first locking means comprises an axial projection provided on said outer cylinder, said axial projection being engageable with a first groove provided in a wall of the cylinder head, said wall defining a hole in which the spark plug is installed.

3. The tool according o claim 2, wherein said axial projection has a second groove for receiving herein a lead wire o the pressure sensor.

4. The tool according o claim 2, wherein said second locking means comprises a locking leg provided on a lower end of said outer cylinder and a peripheral cut provided on the gasket, said peripheral cut being fittingly engageable with said locking leg.

5. The tool according o claim 2 wherein said second locking means comprises a recess provided on a lower end of said outer cylinder and a peripheral projecting provided on the gasket, said peripheral projection being fittingly engageable with said recess.

6. The tool according to claim 1, wherein said engaging means comprise a hexagonal hole provided on a lower end portion of said inner cylinder, said hexagonal hole being fittingly engageable with a hexagonal portion of the spark plug.

7. The tool according to claim 1, wherein said inner cylinder has an upper end portion that defines an attaching hole whereat the tool is driven.

8. The tool according to claim 2, further comprising a plurality of galls for rotatable supporting said inner cylinder on said outer cylinder.

9. A tool unit for loosening or tightening a spark plug while interposing a gasket and a pressure sensor between the spark plug and a cylinder head, the gasket being for disposition between the spark plug and the pressure sensor, the tool unit comprising:

a socket having concentric, relatively rotatable inner and outer cylinders;

said inner cylinder having a hexagonal hole for engaging a hexagonal portion of the spark plug for rotation therewith;

first locking means for lockingly engaging said outer cylinder with the cylinder head; and second locking means or lockingly engaging said outer cylinder with the gasket.

10. The tool unit according o claim 9, wherein the cylinder head has a wall defining a spark plug attaching hole, and said first locking means comprises an axial projection provided on said outer cylinder and a first recess formed in the wall defining the spark plug attaching hole, said first recess being engageable with said axial projection.

11. The tool unit according to claim 10, wherein said second locking means comprises a locking leg provided on a lower end of said outer cylinder, and a peripheral cut provided on the gasket, said peripheral cut being fittingly engageable with said locking leg.

12. The tool unit according to claim 10, wherein said second locking means comprises a second recess provided on a lower end of said outer cylinder, and a peripheral projection provided on the gasket, said peripheral projection being fittingly engageable with said second recess.

* * * * *